United States Patent [19]

Desprez et al.

[11] 4,295,433

[45] Oct. 20, 1981

[54] TAKE-UP DRIVE FOR A MULTI-HEAD EMBROIDERY MACHINE

[75] Inventors: Alfred Desprez, Wachtendonk; Heinz Sauerland, Neukirchen-Vluyn; Wolfgang Teetz, Kerken, all of Fed. Rep. of Germany

[73] Assignee: Maschinenfabrik Carl Zangs Aktiengesellschaft, Krefeld, Fed. Rep. of Germany

[21] Appl. No.: 64,273

[22] Filed: Aug. 6, 1979

[30] Foreign Application Priority Data

Aug. 11, 1978 [DE] Fed. Rep. of Germany ..... 2835185

[51] Int. Cl.[3] ..... D05C 11/00; D05C 7/00

[52] U.S. Cl. ..... 112/241; 112/98; 112/155

[58] Field of Search ..... 112/241, 242, 243, 249, 112/78, 98, 100, 96, 97, 155

[56] References Cited

U.S. PATENT DOCUMENTS 2,525,312 10/1950 Prazak et al. ..... 112/98

2,889,792 6/1959 Scheibel ..... 112/98

3,968,759 7/1976 Reich ..... 112/96 X

FOREIGN PATENT DOCUMENTS 356012 9/1961 Switzerland ..... 112/155

*Primary Examiner*—Werner H. Schroeder

*Assistant Examiner*—Andrew M. Falik

*Attorney, Agent, or Firm*—Martin A. Farber

[57] ABSTRACT

An apparatus for the drive of the thread take-up on multi-head embroidery machines with at least one embroidery needle in each head, with which the thread take-up comprises a thread take-up lever, which thread take-up lever is mounted on the embroidery head pivotable back and forth about a horizontal axis and is driven by the machine main shaft. The thread take-up levers of all embroidery heads are secured on a common thread take-up shaft, the latter extending over the entire length of the machine. The thread take-up shaft is driven by a crankdrive mechanism from the main shaft of the machine.

7 Claims, 5 Drawing Figures

TAKE-UP DRIVE FOR A MULTI-HEAD EMBROIDERY MACHINE

Figure 1:
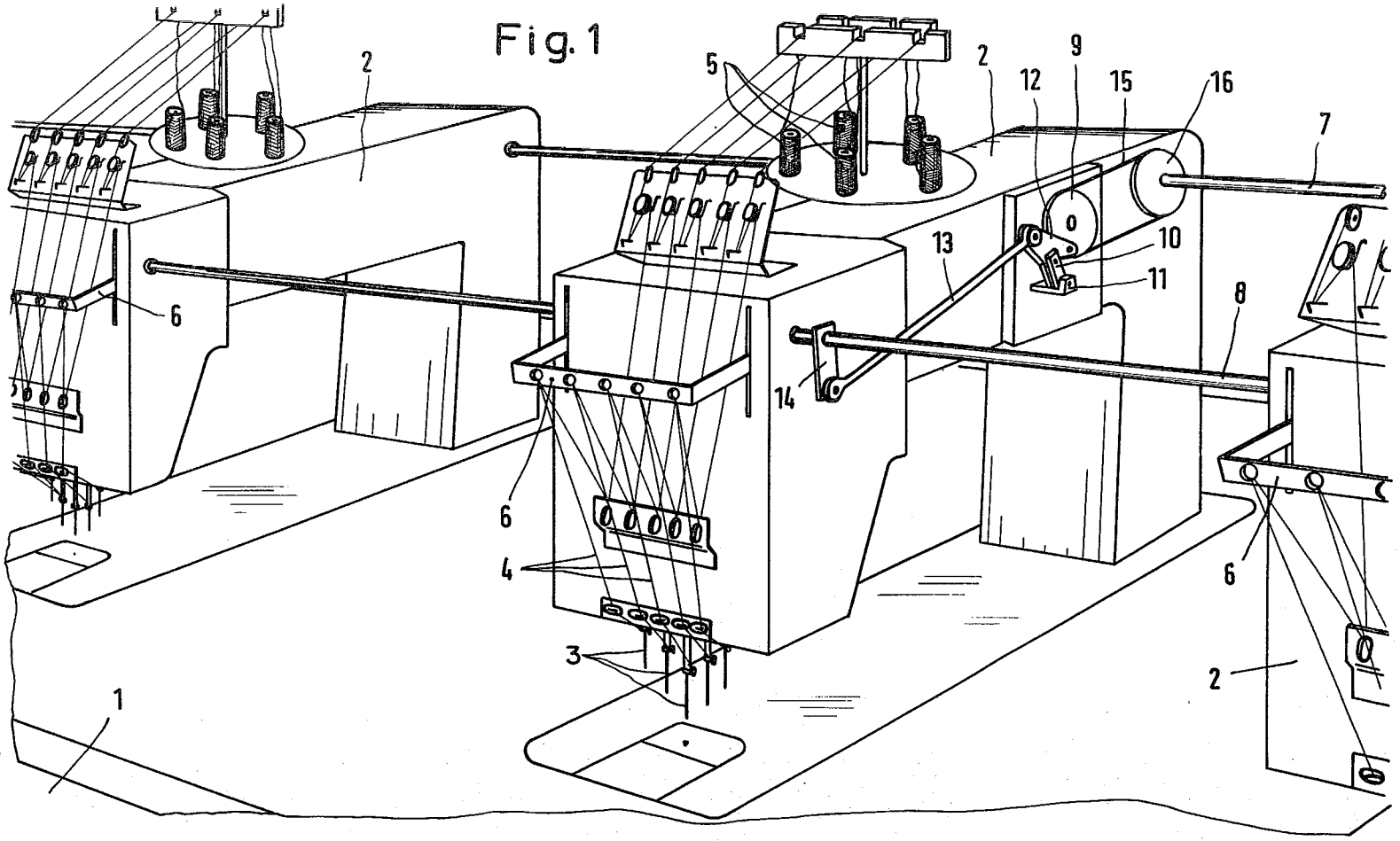

The invention relates to an apparatus for the drive of the thread take-up unit on multi-head embroidery machines with at least one embroidery needle on each head, with which the thread take-up unit comprises a thread take-up lever which is mounted on the embroidery head pivotable back and forth about a horizontal axis and is driveable by the machine main shaft via a cam.

With the known multi-head embroidery machines the drive of the thread take-up lever takes place directly or via intermediate levers by a cam which is formed as a grooved cam. A roller constituting a transmission element runs in this grooved cam. In order to facilitate a rolling of this roller in the grooved cam, the assembly must have a certain play. With every load reversal and the consequently associated change of the running surface of the roller in the grooved cam, the roller suddenly changes its running direction. The accelerations and decelerations of the roller caused by this always cause slipping on the running surface of the grooved cam. In this manner not only does a high wear and tear of the roller and of the grooved cam occur, but moreover, the disadvantage occurs that particularly with high speed machines the necessary play between the roller and the grooved cam causes loud noise. In spite of an expensive circulating lubrication system, the known thread take-up drives consequently are subjected to high wear and frequent disturbances, and within a short time at least cause a breakdown of the thread take-up transmission.

It is an object of the invention to provide an apparatus for the drive of the thread take-up on multi-head embroidery machines without the previously mentioned disadvantages, which apparatus has a simple construction, as low wear as possible and a reliable operation. Moreover, there is possible an exact adjustment of the thread take-up levers of all embroidery heads relative to one another as well as with respect to other moving parts of the multi-head embroidery machine.

In accordance with the invention the thread take-up levers of all embroidery heads are secured on a common thread take-up shaft, the latter extending over the entire length of the machine, and the thread take-up shaft is driven by means of a crankdrive mechanism from the main shaft of the machine.

By the use of one thread take-up shaft extending continuously across the entire length of the machine, the individual thread take-up levers are set exactly relative to one another during the assembly of the multi-head embroidery machine, without readjustment being necessary at a later time. Consequently there is always an exact, identical movement of the thread take-up levers of all of the embroidery heads, since the thread take-up shaft is driven by means of one crankdrive mechanism from the main drive shaft.

Further in accordance with another feature of the invention the crankdrive mechanism comprises a crank disc, which crank disc is driven by the main shaft of the machine, an oscillating crank, the latter being articulated to the machine frame, and a connection rod, which connection rod by means of a drive rod is operatively articulated to a drive arm, the latter being fastened to the thread take-up shaft. These parts of the crankdrive mechanism exclusively are rotatably mounted machine elements, which elements can be formed so as to be free of play; and by using various bearings, such as e.g., slide bearings, or ball and roller bearings under certain circumstances these elements do not require servicing. By adjustment of the lengths and articulation points of the individual parts of the crankdrive mechanism, the stroke and movement courses of the thread take-up levers can be selected at will, without requiring complicated cams which are prone to failure.

In order to prevent twisting of the thread take-up shaft, according to an additional feature of the invention the drive arm is fastened to the take-up shaft approximately in the center of the thread takeup shaft.

Finally, according to another feature of the invention, the crank disc is driven by means of a chain (15, FIG. 2) or toothed belt (15', FIG. 2*a*) and by means of a chain wheel (16) or toothed gear (16'), the chain wheel or toothed gear being fastened on the main shaft of the machine adjustable in the circumferential direction. By an adjustment of the chain wheel or toothed gear on the main shaft of the machine, consequently the movement course of the thread take-up levers may be adjusted in a simple manner to the movement course of the other moveable parts of the multi-head embroidery machine, and also this adjustment occurs in common for all thread take-up levers.

In summary, with the invention there is provided an apparatus for the drive of the thread feeder on multi-head embroidery machines which is simple in construction and of easy adjustability is good in operation and substantially without problems, and as a consequence of the play-free mounting of all elements, makes possible an improved performance for the multi-head embroidery machine.

Figure 2:
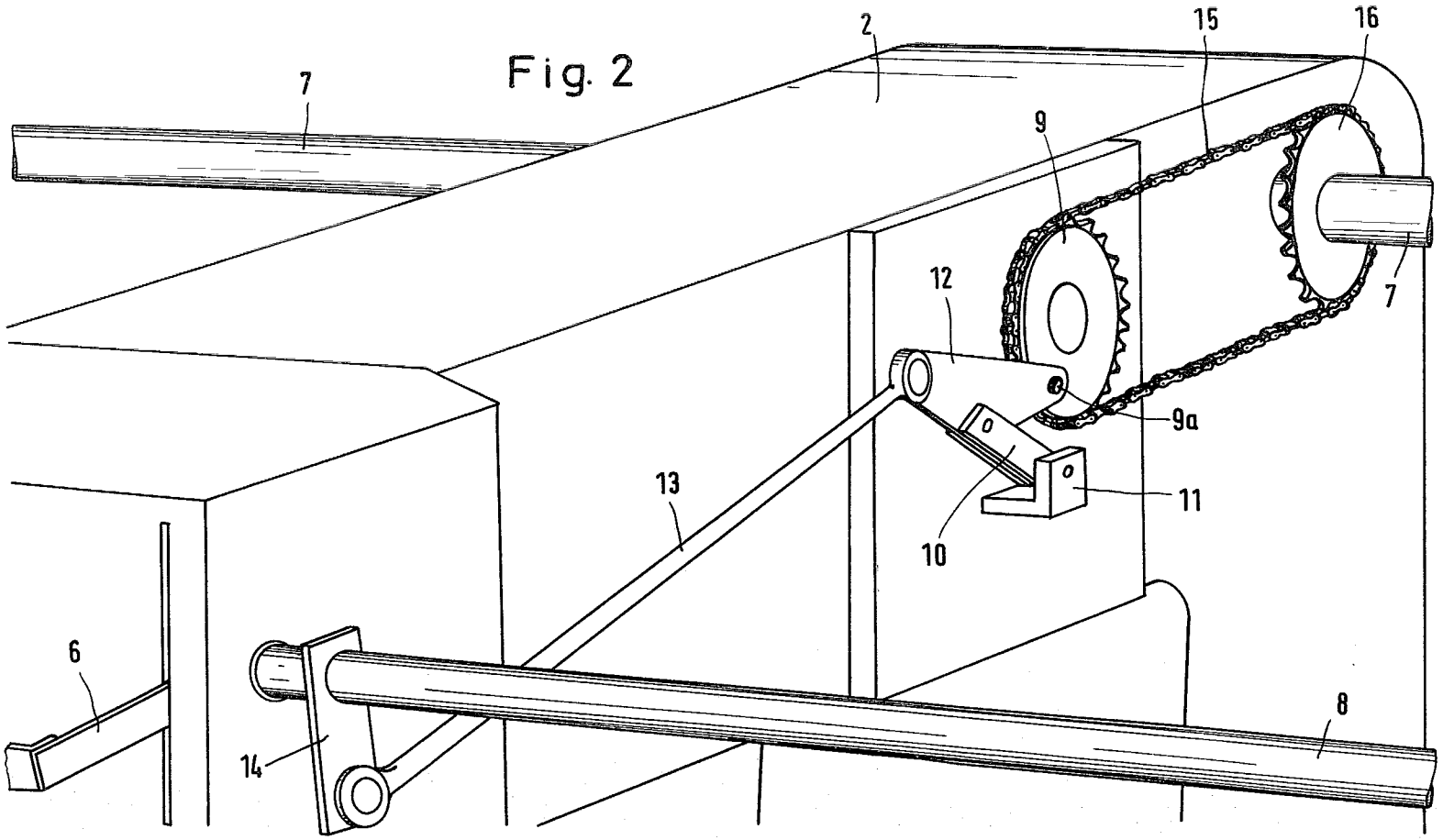
Figure 2A:
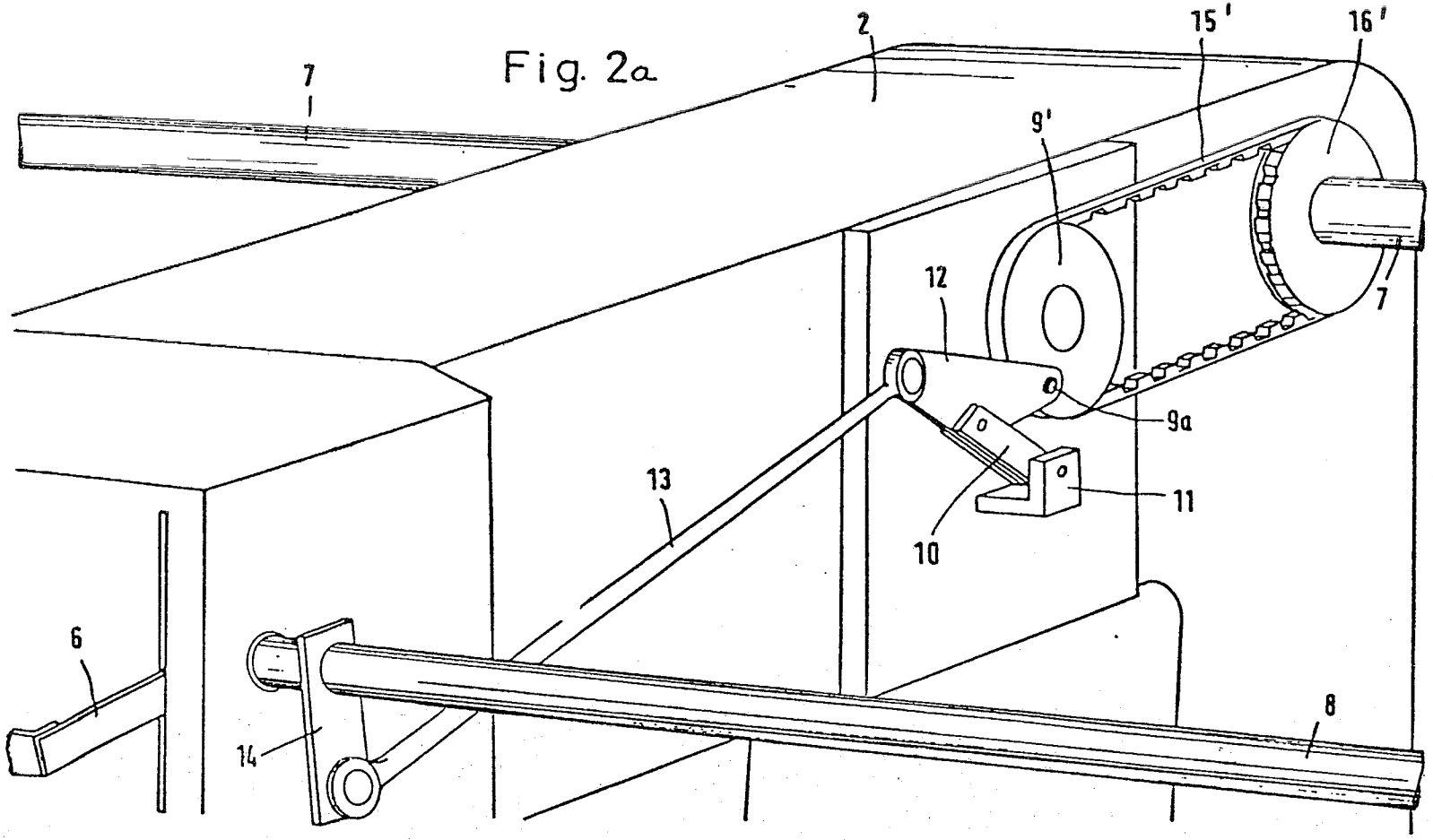
Figure 3:
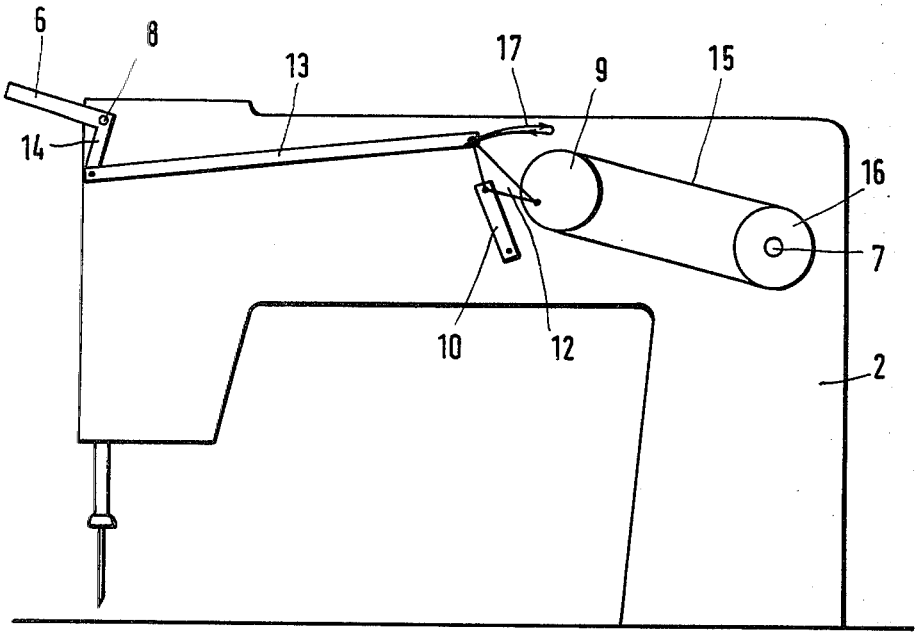
Figure 4:
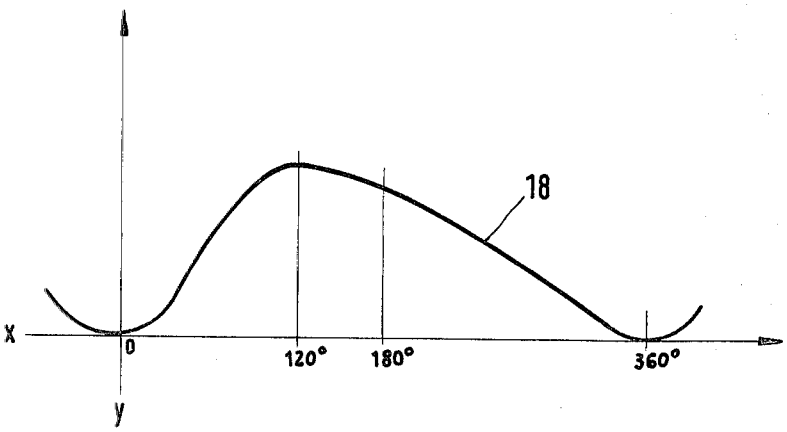

With the above and other objects and advantages in view, the present invention will become more clearly understood in connection with the detailed description of a preferred embodiment, when considered with the accompanying drawings, of which:

FIG. 1 shows a perspective view of three at least partially recognizable embroidery heads of a multi-head embroidery machine, FIG. 2 shows a perspective view in enlarged scale of the crankdrive mechanism which is recognizable at the middle embroidery head in FIG. 1, FIG. 2*a* is a view similar to FIG. 2 but showing a toothed belt in the crankdrive mechanism, FIG. 3 is a schematic side elevational view of this center embroidery head with the crankdrive mechanism, and FIG. 4 is a stroke-rotational angle diagram for the take-up lever of the multi-head embroidery machine shown in FIGS. 1 to 3.

The multi-head embroidery machine illustrated in FIG. 1 has a table 1, on which several embroidery heads 2 are secured. With the illustrated embodiment example each embroidery head in total has five needles 3, from which needles in each case one is selected for the embroidery.

Each needle 3 is provided with a thread 4, which thread is drawn off from a yarn spool 5, by means of a thread take-up lever 6. This thread take-up lever 6 as well as the respectively used embroidering needle 3 of the embroidery heads 2 are driven by one main shaft 7 of the machine, which main shaft runs over the entire length of the multi-head embroidery machine in the rearward area of the embroidery heads 2.

As particularly recognizable from FIGS. 1 and 2, the thread take-up levers 6 of all embroidery heads 2 are fastened on a thread take-up shaft 8, which shaft 8 runs across the entire length of the machine in the front area of each of the embroidery heads 2. This thread take-up shaft 8 is driven by a crankdrive mechanism which is illustrated in enlarged scale in FIG. 2 or FIG. 2*a*.

This crankdrive mechanism comprises a crank disc 9, which crank disc is rotatably mounted on the middle embroidery head 2, as well as a link or oscillating crank 10, the latter being mounted horizontally pivotable on a bearing block or pedestal 11. This bearing block 11 is also fastened on the center embroidery head 2 with the illustrated embodiment example. The connection between the crank pin 9*a* of the crank disc 9 and the oscillating crank 10 takes place by means of a connecting rod 12, the latter being triangularly-shaped in the illustrated embodiment. The third articulation point of this connecting rod 12 is connected with an actuating or drive rod 13, which drive rod acts on a drive arm 14, the drive arm 14 being fastened in the center on the thread take-up shaft 8.

With the illustrated embodiment of FIG. 2 the drive of the crank disc 9 is not directly from the machine drive shaft 7, but via a chain 15. The chain meshes with the teeth of the crank disc 9 and a spocket 16, the latter being fixed to the machine main shaft 7. In FIG. 2*a* a toothed belt 15' meshes with the crank disc 9' and a toothed gear 16', the latter being fastened to the main shaft 7 adjustably in the circumferential direction.

The continuous rotational movement of the machine main shaft 7 is transmitted by means of the chain wheel 16 and of the chain 15 to the crank disc 9. By means of its crank pin 9*a*, in connection or cooperation with the oscillating crank 10 there is imparted to the front articulation point of the connecting rod 12 an oscillating movement, which oscillating movement is shown by the curve 17 in FIG. 3. The rear end of the drive rod 13 is moved correspondingly to this curve 17. The front end of this drive rod 13, via the drive arm 14 and the thread take-up shaft 8 passing therethrough, imparts to each thread take-up lever 6 a stroke movement 18 which is dependent on the angle of rotation, as illustrated in the diagram of FIG. 4.

In order to be able to adjust this stroke movement 18 of all thread take-up levers 6 to the other movement course of all embroidery heads 2, the chain wheel 16 is adjustable in the circumferential direction on the machine main shaft 7. By rotation of the chain wheel 16 on the machine main shaft 7, consequently in a simple manner an adjustment of the movement course of all thread pick-up levers 6 in relationship to the movement course of the other parts of the multi-head embroidery machine takes place, which other parts likewise are driven by the machine main shaft 7.

We claim:

1. In an apparatus for the drive of the thread take-up on a multi-head embroidery machine having a machine frame, with a plurality of embroidery heads arranged in a row, with at least one embroidery needle in each head, the oscillating thread take-up comprising a thread take-up lever for each embroidery head respectively, which thread take-up lever is mounted on the respective embroidery head pivotable back and forth about a horizontal axis and is operatively driveable by a machine main shaft, the improvement comprising one common thread take-up shaft extending to and passing through all of the embroidery heads, said thread take-up levers of all of the embroidery heads are secured on said common thread take-up shaft, means comprising a single crankdrive mechanism for driving said common thread take-up shaft by the machine main shaft.

2. The apparatus according to claim 1, wherein said crankdrive mechanism is a single crankdrive mechanism, whereby all said thread take-up levers are driven simultaneously by the single crankdrive mechanism from the machine main shaft.

3. In an apparatus for the drive of the thread take-up on a multi-head embroidery machine having a machine frame, with a plurality of embroidery heads and at least one embroidery needle in each head, the thread take-up comprising a thread take-up lever for each embroidery head, which thread take-up lever is mounted on the respective embroidery head pivotable back and forth about a horizontal axis and is operatively driveable by a machine main shaft, the improvement comprising a common thread take-up shaft extending over the entire length of the machine, said thread take-up levers of all embroidery heads are secured on said common thread take-up shaft, means comprising a crankdrive mechanism for driving said thread take-up shaft from the machine main shaft, said crankdrive mechanism comprises, a crank disc operatively driveably connected by the main shaft, an oscillating crank articulated to the machine frame, and a connection rod connected to said oscillating crank and to said crank disc, a drive rod connected to said connection rod, a drive arm secured to said common thread takeup shaft, said drive arm is articulated to said drive rod, whereby said connection rod via said drive rod is connected articulatedly with said drive arm for driving said common thread take-up shaft from the machine main shaft.

4. The apparatus according to claim 3, wherein said drive arm is fastened to said thread take-up shaft approximately in the center lengthwise of the thread take-up shaft.

5. The apparatus according to claim 6, further comprising a chain wheel fastened on the machine main shaft adjustable in the circumferential direction, a chain operatively mounted on said chain wheel and on said crank disc, whereby said crank disc is driven by means of said chain belt and by means of said chain wheel.

6. The apparatus according to claim 3, further comprising a toothed gear fastened adjustably in the circumferential direction on the machine main shaft, a toothed belt operatively mounted on said toothed gear and on said crank disc, whereby said crank disc is driven by means of said toothed belt and by means of said toothed gear.

7. The apparatus according to claim 3, wherein said connection rod forms a triangle having three angle points and is articulated to said drive rod, said oscillating crank and said crank disc adjacent the respective angle points of the triangle.

* * * * *